United States Patent [19]

Leinfelt

[11] 4,363,156

[45] Dec. 14, 1982

[54] VACUUM CLEANER DUST CONTAINER HAVING COMPRESSING MEANS ASSOCIATED THEREWITH

[75] Inventor: Karl E. Leinfelt, Stockholm, Sweden

[73] Assignee: Aktiebolaget Electrolux, Stockholm, Sweden

[21] Appl. No.: 254,066

[22] Filed: Apr. 14, 1981

[30] Foreign Application Priority Data

Apr. 18, 1980 [SE] Sweden ..... 8002906

[51] Int. Cl.[3] ..... A47L 9/12

[52] U.S. Cl. ..... 15/327 R; 55/361; 55/417; 55/428; 55/467; 55/475; 55/DIG. 3

[58] Field of Search ..... 55/213, 283, 299, 304, 55/301, 428, 467, 475, DIG. 3, 361, 417; 15/319, 327 E, 352, 327 R

[56] References Cited

U.S. PATENT DOCUMENTS

| | | | |
|---|---|---|---|
| 1,991,859 | 2/1935 | Lofgren | 55/213 |
| 2,022,249 | 11/1935 | Lofgren | 15/352 |
| 2,174,443 | 9/1939 | Lofgren | 15/327 E X |
| 2,507,043 | 5/1950 | Osborn | 55/213 X |
| 3,407,572 | 10/1968 | Tolley | 55/283 |
| 3,466,696 | 9/1969 | Grellsson | 15/327 E |
| 4,277,265 | 7/1981 | Leinfelt | 55/428 X |

FOREIGN PATENT DOCUMENTS

| | | | |
|---|---|---|---|
| 54-103262 | 8/1979 | Japan | 55/304 |
| 54-103263 | 8/1979 | Japan | 55/428 |

*Primary Examiner*—Kathleen J. Prunner
*Attorney, Agent, or Firm*—Alfred E. Miller

[57] ABSTRACT

A vacuum cleaner having an air non-pervious body in the shape of a closed bellows in the suction chamber thereof with one end of the bellows bearing against the dust container, and the other end bearing against a partition separating the suction chamber from a positive pressure chamber housing the motor-fan unit. The bellows communicates with the pressure chamber through a conduit so that the bellows can be brought into communication with the positive pressure side of the fan so that the bellows expands and compresses said dust container and its contents, and thus increases the filling capacity of the dust container. The running costs of operating a vacuum cleaner is thus substantially reduced.

6 Claims, 2 Drawing Figures

VACUUM CLEANER DUST CONTAINER HAVING COMPRESSING MEANS ASSOCIATED THEREWITH

The invention relates to a vacuum cleaner having compressing means for a dust container associated therewith. The compressing means is a non-pervious body to air arranged in the suction chamber and is compressible due to changed pressure conditions therein.

It is known to compress a dust container for obtaining a higher filling factor for the same when a vacuum cleaner is operative. This arrangement makes is possible to continue to use dust containers in vacuum cleaners for their optimum utilization. Thus, two frequent changes of dust containers are eliminated. This arrangement has a further advantage of decreasing the running cost of vacuum cleaners. In a known arrangement which is set forth in applicant's copending patent application Ser. No. 86,353, filed on Oct. 19, 1979, and now U.S. Pat. No. 4,277,265, issued on July 7, 1981 a dust container is shown and described which together with its contents is compressible by means of an air non-pervious body surrounding the dust container. In this arrangement the outside of the non-pervious body is temporarily exposed to atmospheric pressure whereby the dust container is compressed due to the negative pressure prevailing inside the dust container.

Through experimentation it has been proved that the known arrangement can be improved further, and the filling capacity of the dust container can be increased considerably over the limit known heretofore. This desirable result is essentially achieved in that the air non-pervious body has the shape of a closed bellows, the inner space of which can be brought into communication with the positive pressure of the motor fan unit.

Figure 1:
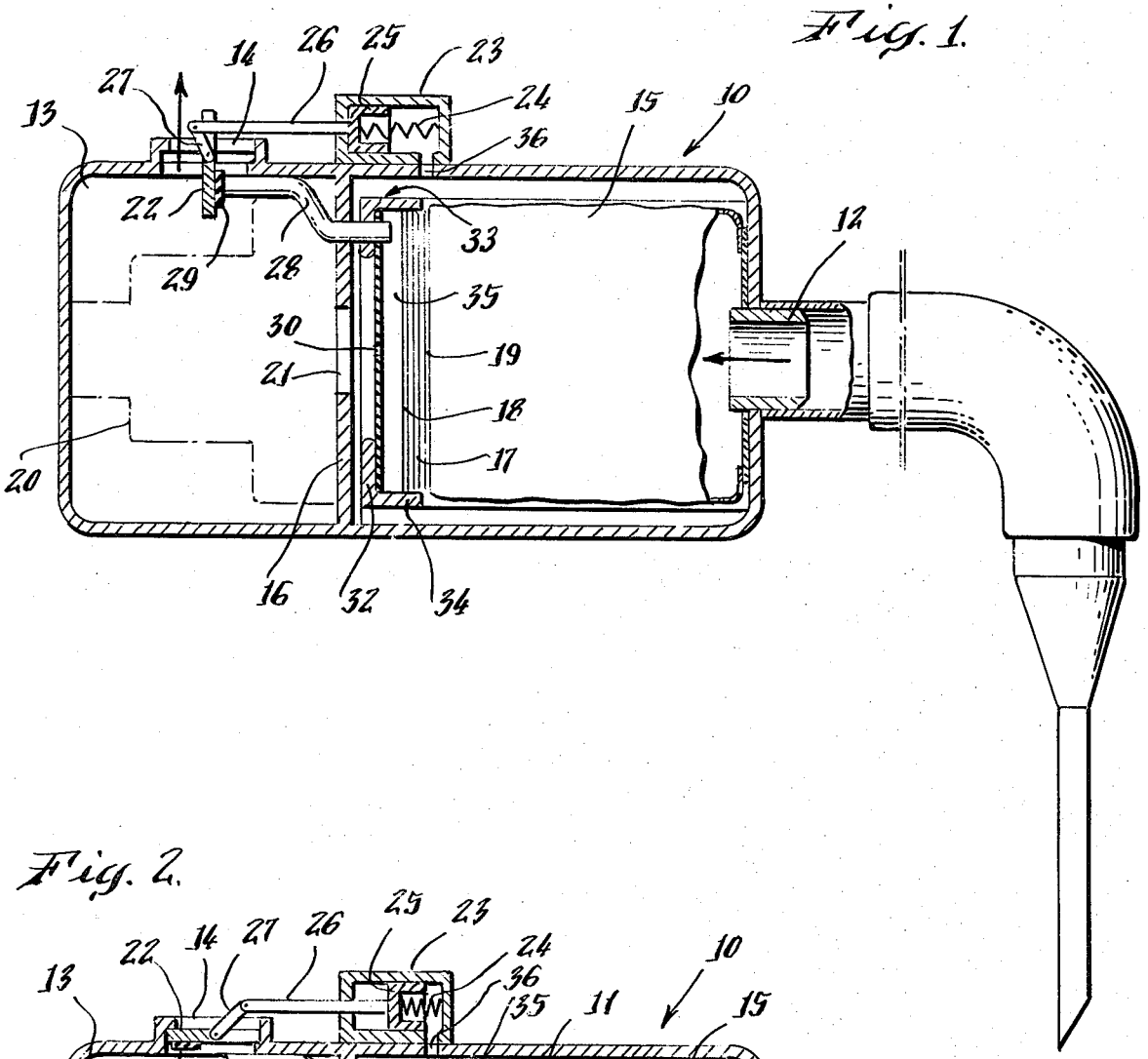
Figure 2:
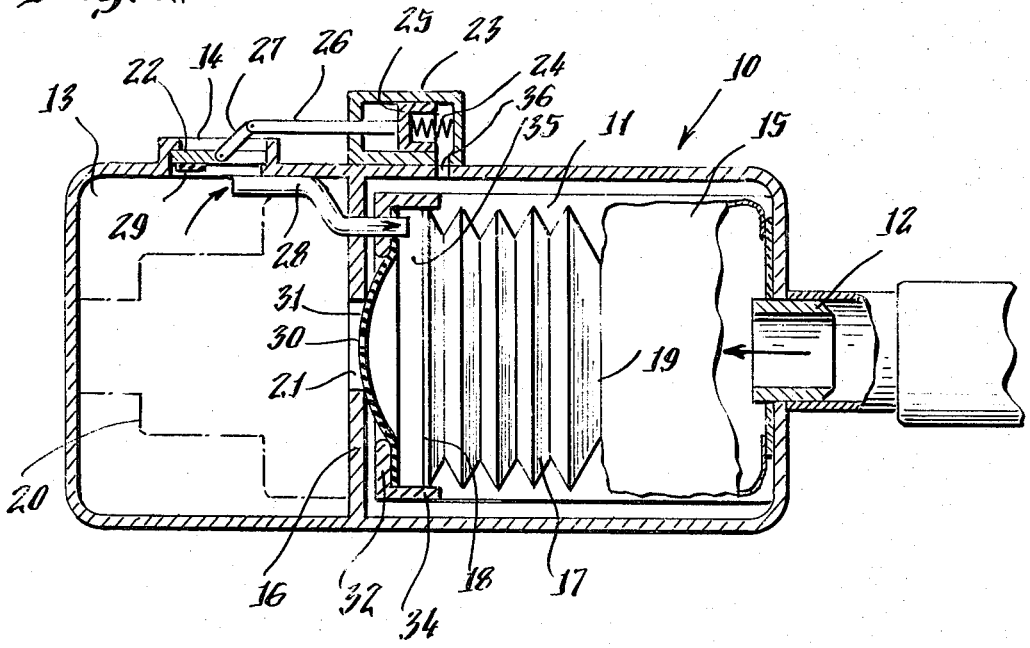

In order that the invention will be more clearly understood, it will now be disclosed iin greater detail with reference to the accompanying drawings, in which:

FIG. 1 is a sectional view showing a vacuum cleaner with the dust container operating under normal running condition, and FIG. 2 illustrates the dust container in a compressed condition.

The housing defining a part of the vacuum cleaner is referred to generally by the reference numeral 10, and contains a suction chamber 11 having an inlet opening 12 for dust-laden air and a pressure chamber 13 with an outlet opening 14. A partition 16 separates the suction chamber 11 from the pressure chamber 13. A dust container 15 is arranged in the suction chamber 11, and an air non-pervious body in the shape of a closed bellows 17 made, for example of rubber, plastic or another suitable material is also located therein. The bellows 17 bears with one of its ends 18 against the partition 16 and with its other end 19 against the dust container 15.

A motor-fan unit 20 for transport of air from the inlet opening 12 through the dust container 15 is positioned in the pressure chamber 13. The dust particles are separated out and the air then moves through the suction opening 21 of the motor-fan unit to the pressure chamber 13 where the air departs from the vacuum cleaner through the outlet opening 14 to the surrounding atmosphere.

The outlet opening 14 is closable during the compressing stage by means of a flap 22, actuated by a member sensing the pressure drop over the dust container wall, said member having the shape of a piston 25 movable within a cylinder 23 against the force of a compression spring 24. A rod 26 connects the front end of the piston with the flap 22 through a lever 27, and permits a movement of the flap from a position closing the outlet opening (FIG. 2) to a position in which the outlet opening is open (FIG. 1). In the open position, one end of the flap 22 closes an air conduit 28 passing through the partition 16 and connecting the pressure chamber 13 with the inner space of the bellows. A seal 29 arranged on the flap ensures an air tight fit between the flap and the mouth of the air conduit 28.

A hole 30, the cross flow area of which is considerably below the inner area of the air conduit 28 is positioned in the central portion of a diaphragm 31 at the end wall 18 of the bellows directed towards wall 33. The diaphragm is arranged at a distance from the suction opening 21 of the motor-fan unit 20 and is attached to a ring-shaped portion 32 of an inner wall 33 by means of its peripheral part. The wall 33 having axial parts 34 forms an enclosure 35 for taking up the bellows 17 during the running stage, as evident from FIG. 1.

The device functions in the following manner: while using the vacuum cleaner, air is taken in through the inlet opening 12 and sucked through the dust container 15 where it is cleaned and delivered by the motor-fan unit 20 through the outlet opening 14 to the surrounding atmosphere, as seen in FIG. 1. When a certain amount of clogging of the inside of the dust container has taken place, and the pressure drop over the dust container wall has increased sufficiently, i.e., the negative pressure on the outside of the dust container is sufficiently high, the negative pressure prevailing on the outside of the dust container is through conduit 36 transmitted to the inside of the piston 25 which then moves against the force of spring 24 from the position shown in FIG. 1 to the second position shown in FIG. 2. This movement is transmitted by means of a rod 26 and lever 27 to the flap 22, which pivots to the position illustrated in FIG. 2, and closes the outlet opening 14.

Positive pressure is created in the pressure chamber 13 and air flows through air conduit 28 into the bellows 17, which quickly expands to the position shown in FIG. 2 and compresses the dust container 15. However, before that, the diaphragm 31 has bulged out as seen in FIG. 2, due to the positive pressure prevailing in the bellows, and has sealed the suction opening 21 of the motor-fan unit.

After the occurrence of the foregoing, the air pressure on the outside of the dust container 15 decreases, which is transmitted through conduit 36 to the inside of piston 25, and the piston moves to its initial position shown in FIG. 1. The flap 22 then opens the outlet opening 14, and the bellows is evacuated through hole 30, while the diaphragm 31 opens the suction opening of the motor-fan unit and the bellows returns to its inactive position within the enclosure 35, as seen in FIG. 1.

During the compression function dust has been freed from the walls of the dust container 15 and compressed, so that further dust can be supplied to the dust container and the filling factor of the dust container has been increased in this manner. In actuality, there is about a doubling of the filling factor due to the compressing mode as compared to a conventional apparatus without compression. It should be evident that during vacuum cleaning the compression mode can be repeated several times, and this can be done manually or automatically, as shown in the present embodiment, which is not intended to limit the invention in any respect. Several modifications are thus conceivable within the spirit and scope of the invention, as defined in the following claims. Thus, e.g. the closing of the outlet opening 14, i.e., the initiation of the compression, can be achieved by the aid of magnets, or electronically.

The arrangement according to the present invention is superior to the prior art arrangement as described hereinbefore because the whole available difference between the pressure and suction sides of the fan can be utilized instead of using only the essentially lower difference between the atmospheric pressure and the negative pressure of the vacuum cleaner.

What is claimed:

1. In a vacuum cleaner having a working implement and having a suction chamber provided with an inlet for dust-laden air, a suction hose, a dust container, an outlet opening for cleaned air, and a motor-fan unit for transport of air from said working implement through said suction hose and dust container, the improvement comprising: a housing constituting a pressure chamber and said suction chamber, said pressure chamber in said housing having said outlet opening and said motor-fan unit therein, said suction chamber having said dust container and an air non-pervious, closed bellows, a partition in said housing separating said suction chamber from said pressure chamber, said bellows being arranged between said dust container and said partition, a suction opening for said motor-fan unit in said pressure chamber located in said partition, means for selectively closing the outlet opening for cleaned air, means for removably sealing the suction opening in said partition, and an air conduit disposed so as to conduct pressurized air from said pressure chamber to the interior of said bellows when said suction opening and said outlet opening are closed to thereby expand said bellows and compress said dust container whereby accumulated dust in the dust container is compressed.

2. The device as claimed in claim 1 further comprising an inner wall in said suction chamber adjacent to said partition, and wherein said bellows has one end surface bearing against said inner wall, and an opposed end surface bearing against said dust container.

3. The device as claimed in claim 1 wherein said air conduit passes through said partition.

4. The device as claimed in claim 1 further comprising a hole in one end wall of said bellows directed toward said suction opening for evacuation of air from the bellows when said outlet opening has been opened and compression of said dust container has been terminated.

5. A device as claimed in claim 4 wherein the end wall of said bellows directed toward said suction opening is formed by a normally flat diaphragm having said hole in its central portion, said diaphragm during the application of pressurized air to the interior of the bellows functions to seal the suction opening.

6. A device as claimed in claim 1, wherein said means for selectively closing the outlet opening comprises a flap operable to close said outlet opening and a member sensing the pressure drop over a wall of said dust container, and said flap being operated by said member.

* * * * *